United States Patent [19]

Vanassche et al.

[11] 4,081,281

[45] * Mar. 28, 1978

[54] DEVELOPING LOW FOGGED, DIRECT-POSITIVE SILVER HALIDE EMULSION WITH AN ENERGETIC DEVELOPER FREE FROM HALIDE IONS

[75] Inventors: Willy Joseph Vanassche, Aartselaar; Herman Alberik Pattyn, Kapellen; Hendrik Alfons Borginon, Mortsel, all of Belgium

[73] Assignee: AGFA-GEVAERT N.V., Mortsel, Belgium

[ * ] Notice: The portion of the term of this patent subsequent to Jun. 15, 1993, has been disclaimed.

[21] Appl. No.: 563,397

[22] Filed: Mar. 31, 1975

Related U.S. Application Data

[63] Continuation of Ser. No. 318,988, Dec. 27, 1972, abandoned.

[30] Foreign Application Priority Data

Feb. 18, 1972 United Kingdom ..... 7743/72

[51] Int. Cl.[2] ..... G03C 5/24

[52] U.S. Cl. ..... 96/64; 96/107; 96/108; 96/101; 96/66.1

[58] Field of Search ..... 96/64, 107–108, 96/101, 66.1

[56] References Cited

U.S. PATENT DOCUMENTS

| | | | |
|---|---|---|---|
| 3,501,307 | 3/1970 | Illingsworth | 96/101 |
| 3,558,320 | 1/1971 | Brooker et al. | 96/101 |
| 3,615,643 | 10/1971 | Shiba et al. | 96/64 |
| 3,713,832 | 1/1973 | Shiba et al. | 96/101 |
| 3,730,723 | 5/1973 | Gilman et al. | 96/107 |
| 3,733,198 | 5/1973 | Vanreusel et al. | 96/64 |
| 3,761,267 | 9/1973 | Gilman et al. | 96/64 |
| 3,785,824 | 1/1974 | Fisch | 96/66.1 |
| 3,963,493 | 6/1976 | Vanassche et al. | 96/64 |

*Primary Examiner*—Won H. Louie, Jr.
*Attorney, Agent, or Firm*—A. W. Breiner

[57] ABSTRACT

A method of producing direct-positive images is provided which comprises developing an exposed direct-positive silver halide emulsion comprising electron-traps and fogged silver halide grains in the absence of halide ions so as to obtain higher maximum density. It is possible to decrease the degree of fogging so as to obtain direct-positive emulsions of high-sensitivity which, when developed in the absence of halide ions, still provide favorable maximum density values.

14 Claims, No Drawings

DEVELOPING LOW FOGGED, DIRECT-POSITIVE SILVER HALIDE EMULSION WITH AN ENERGETIC DEVELOPER FREE FROM HALIDE IONS

This is a continuation of application Ser. No. 318,988 filed Dec. 27, 1972 now abandoned.

The present invention relates to development of exposed photographic direct-positive silver halide elements.

It is known that direct-positive images can be obtained with certain types of photographic silver halide emulsions without previously forming a negative silver image. For this purpose, the silver halide grains are fogged by an overall-exposure to actinic radiation or by an overall chemical fogging, e.g. by means of reducing agents, before or after they are coated on a support. Upon image-wise exposure of the prefogged emulsions the development centres formed by said fogging are destroyed at the exposed areas and remain at the unexposed areas. By subsequent conventional development by means of silver halide developers a direct-positive image is formed.

A particularly suitable class of direct-positive silver halide emulsions consists of direct-positive silver halide emulsions comprising electron-traps. This class includes emulsions comprising compounds acting as electron acceptors or desensitizers such as desensitizing dyes, which are absorbed to the surface of the fogged silver halide grains. It also includes emulsions that comprise silver halide grains having in their interior centres promoting the deposition of photolytic silver, the said centres forming the electron-traps.

One of the advantages of such direct-positive emulsions is that the high-light areas of the images obtained with these materials are substantially free from fog. However, such materials did not exhibit the high speed required for many applications of photography. It is evident, therefore, that there is need in the art for improved direct-positive photographic materials having increased speed.

It is known to obtain improved photographic speeds by reducing the degree of fogging so that the fogging centres are more rapidly destroyed at the exposed areas during the exposure step. For example, in U.S. Pat. No. 3,501,307 of Bernard D. Illingsworth issued Mar. 17, 1970 a low level of reduction fogging is combined with a low level of gold fogging of the silver halide grains the degree of fogging being such that the emulsion satisfies a specific chemical bleach test. Note column 6, lines 58 – 63 thereof, where it is stated that the silver halide grains are fogged so as to produce a density of at least 0.5 when developed without exposure for 5 minutes at 68° F. in Kodak DK-50 developer when such an emulsion is coated at a coverage of 50 to about 500 mg. of silver per square foot of support. According to the copending U.S. Ser. No. 318,989, now U.S. Pat. No. 3,963,493, in the name of Willy Joseph Vanassche et al filed on even date herewith, it is possible in order to increase the speed of direct-positive emulsions comprising electron-traps to further diminish the degree of fogging, even to a point where strictly speaking no fogging as defined in the said U.S. Pat. No. 3,501,307 of Bernard D. Illingsworth issued Mar. 17, 1970 is observed.

However, it is also known that reducing the degree of fogging results in a reduction of the maximum density of the direct-positive image formed. Therefore, emulsions whose silver halide grains have been fogged to a very low degree might become unsuitable for practical use since upon common development the images produced have too low a maximum density.

It has now been found that the maximum density of these direct-positive images can be markedly increased by effecting development of the exposed direct-positive silver halide emulsion, substantially in the absence of halide ions, which are normally present, especially in the form of potassium bromide and/or potassium iodide, in silver halide developing compositions.

The present invention thus provides a method of producing a direct-positive image, which comprises exposing image-wise to radiation a photographic direct-positive silver halide element having at least one direct-positive silver halide emulsion layer comprising electron-traps and uniformly fogged radiation-sensitive silver halide grains, and developing the exposed emulsion by means of a silver halide developing agent, characterized in that development occurs by means of a developing composition or development activating composition that is substantially free from halide ions.

It is normally desirable for the liquid medium used in the processing of exposed direct-positive silver halide elements to be used repeatedly for processing successive elements. During such repeated use the developing medium inevitably becomes contaminated with halide ions. The present invention is therefore of particular value when employed in the development of exposed direct-positive silver halide elements by means of a developing composition for one-time use, especially viscous developing compositions comprising thickening agents, more particularly water-soluble film-forming materials.

The invention can however be performed in processing by means of a medium which is used more than once because the processing of the first element can be in the substantial absence of halide ions and there may be no significant quantity of halide ions until after a number of elements have been processed.

By developing the exposed direct-positive silver halide emulsions of the type described substantially in the absence of halide ions it is not only possible to increase substantially the maximum density obtainable upon development of these exposed direct-positive silver halide emulsions but also as compared with the above U.S. Patent to further decrease the degree of fogging and thus to further enhance the speed of these direct-positive silver halide emulsions and nevertheless obtain sufficient maximum density upon development. As a consequence, the terms "fogged" and "fogging" as used herein are employed in a very broad sense so that very low degrees of fogging are also embraced. In carrying out the present invention the degree of fogging is such that a test portion of the silver halide emulsion, when coated on a support at a coverage of 0.50 g to 5.50 g of silver per sq.m gives a density of at least 0.50 upon processing, without exposure, for 3 minutes at 20° C in a test developer of the following composition:

| | |
|---|---|
| hydroquinone | 15 g |
| 1-phenyl-3-pyrazolidinone | 1 g |
| trisodium salt of ethylenediamine tetra-acetic acid | 1 g |
| anhydrous sodium carbonate | 30 g |
| anhydrous sodium sulphite | 70 g |
| 40% aqueous sodium hydroxide | 16 ml |
| water to make | 1 liter |

-continued (pH :11)

Thus it is preferable to use in the performance of the invention a photographic material comprising a direct-positive silver halide emulsion layer that has been fogged to a degree, which gives at least a said density upon a said processing.

Development may occur in alkaline solutions containing conventional developing agents such as hydroquinones, catechols, aminophenols, 3-pyrazolidones, phenylene diamines, ascorbic acid and derivatives, hydroxylamines, etc. or combinations of developing agents. The exposed direct-positive emulsion may be developed to produce direct-positive black-and-white images or it may be developed to produce a direct-positive colour image by means of an aromatic primary amino colour developing agent, more particularly one of the known p-phenylenediamine developing agents, in the presence of a colour coupler, which coupler can be incorporated in the emulsion or in the developing composition.

Development preferably occurs by means of a combination of developing agents that have a superadditive action, e.g. hydroquinone together with N-methyl-p-aminophenol sulphate or another p-aminophenol derivative and hydroquinone or ascorbic acid together with 1-phenyl-3-pyrazolidinone or other 3-pyrazolidinone derivatives.

It is very advantageous to employ energetic developers, especially when the silver halide grains of the direct-positive silver halide emulsion have been fogged to a very low degree, e.g. to the extent described in U.S. Pat. No. 3,501,307 of Bernard D. Illingsworth issued Mar. 17, 1970, or even to a lower extent as described in the co-pending U.S. Ser. No. 318,989, now U.S. Pat. No. 3,963,493, in the name of Willy Joseph Vanassche et al filed on even date herewith for "Direct-positive photographic silver halide emulsions".

The high-energy may be obtained by properly alkalizing the developing composition (pH 9–12), by using relatively high concentrations of ingredients in the developer, by using high energy developing agents or a combination of developing agents which when used together are known to produce a superadditive effect for example hydroquinone/1-phenyl-3-pyrazolidinone and hydroquinone/N-methyl-p-aminophenol sulphate, by addition to the developer or development accelerators, e.g. polyethylene glycol and other polyoxyalkylene compounds as well as quaternary ammonium or phosphonium compounds and ternary sulphonium compounds. For example, favourable results are obtained by means of developing compositions comprising per liter at least 5 g of hydroquinone and an auxiliary superadditive developing agent of the pyrazolidinone type especially 1-phenyl-3-pyrazolidinone, whose optimum concentration relative to the amount of hydroquinone can be determined by routine laboratory experiments. Favourable results are also obtained with compositions comprising as developing agents ascorbic acid and 1-phenyl-3-pyrazolidinone.

One or more developing agents can be incorporated in the direct-positive photographic element. They can be incorporated in the silver halide emulsion itself and/or in another suitable location in the photographic element. Development can then be effected by means of alkaline processing composition called development activator composition, which is substantially free from developing agents.

The processing composition, which is used to effect development of the exposed direct-positive silver halide emulsion and, which comprises or does not comprise one or more developing agents is preferably supplied in an amount that suffices for the treatment of exactly one piece of light-sensitive element. In this case this liquid is called a single-use bath. A bath of this type offers the advantage that ageing and contamination of the bath composition are eliminated. For one-time use the processing composition is preferably relatively viscous. Viscous processing compositions can be obtained by addition of a thickening agent, preferably a water-soluble film-forming material e.g. a water-soluble plastic. The film-forming plastic may be any of the high molecular weight polymers that are stable to alkali and that are soluble in aqueous alkaline solutions, e.g. hydroxyethyl cellulose, starch or gum, polyvinyl alcohol, the sodium salts of polymethacrylic acid and polyacrylic acid, sodium alginate, sodium carboxymethylcellulose etc. The relatively viscous processing composition may be confined within a container, which is ruptured at the moment of development as is done, e.g. in the well-known silver complex diffusion transfer process for in-camera processing.

The direct-positive silver halide emulsion for use in accordance with the present invention can be fogged in any suitable manner, which consists of providing the silver halide grains with silver nuclei and/or nuclei of a metal more electropositive than silver including gold, platinum, palladium, iridium, etc.

The silver halide grains can be provided with silver nuclei, e.g. by an overall uniform exposure to actinic radiation and preferably by reduction sensitization for example by high pH and/or low pAg silver halide precipitating or digestion conditions e.g. as described by Wood, J.Phot. Sci. 1 (1953) 163, or by treatment with reducing agents. Suitable reducing agents include tin(II) salts e.g. tin(II) chloride, tin complexes and tin chelates of the (poly)amino (poly)carboxylic acid type as described in British Pat. Specification 1,209,050 of Agfa-Gevaert N.V. filed Dec. 27, 1967, formaldehyde, hydrazine, hydroxylamine, sulphur compounds such as thiourea dioxide, phosphonium salts such as tetra (hydroxymethyl)-phosphonium chloride, polyamines such as diethylenetriamine, bis(p-aminoethyl) sulphide and its water-soluble salts, etc.; preferred reducing agents are thiourea dioxide and tin(II) chloride.

The silver halide grains can be provided with nuclei of a metal more electropositive than silver, e.g. by treatment of the silver halide grains (which may have been provided with silver nuclei) with a compound of a metal more electropositive than silver, preferably in the form of a water-soluble salt e.g. potassium chloroaurate, gold(III) chloride, ammonium hexachloropalladate, potassium chloroiridate and the like. The treatment with a gold compound may occur by means of a mixture of a water-soluble noble metal compound, e.g. gold (III) chloride and thiocyanates forming complexes with gold and having a solvent action on the silver halide grains, e.g. alkali metal and ammonium thiocyanates.

In the formation of direct-positive silver halide emulsions, fogging of the silver halide grains can alternatively very suitably be effected by reduction sensitization e.g. by means of a reducing agent, e.g. thiourea dioxide, and noble metal sensitization with a compound of a metal more electropositive than silver, especially a gold compound. The reducing agent is preferably used initially and the gold compound subsequently. However, the reverse order can be used or both compounds can be used simultaneously.

Fogging of the silver halide grains can be effected prior to coating of the silver halide emulsions or the emulsions can be coated prior to fogging.

The concentrations of the chemical fogging agents can be varied over a considerable range since the degree of fogging is dependent not only on the concentration of these fogging agents but also on the pH, the pAg, and the temperature conditions as well as the duration of the fogging treatment. As noted hereinbefore, the degree of fogging is preferably such that a test portion of the silver halide emulsion, when coated on a support at a coverage of 0.50 to 5.50 g of silver per sq.m, gives a density of at least 0.50 upon processing without exposure for 3 minutes at 20° C in the above test developer.

The effect of carring out development in the absence of halide ions is especially advantageous for emulsions that have been fogged to a very low degree so that high photographic speeds can be obtained together with favourable values of maximum density.

The direct-positive silver halide emulsions of use in accordance with the present invention may comprise any of the known silver halides suitable for the formation of direct-positive silver halide emulsions e.g. silver bromide, silver chloride, silver chlorobromide, silver bromoiodide, and silver chlorobromoiodide.

Especially suitable for use in accordance with the present invention are direct-positive silver halide emulsions whose silver halide grains have an average grain size of less than about 1 micron, preferably less than 0.5 micron. The silver halide grains may be regular and may have any of the known shapes e.g. cubic, octahedral or even rhombohedral. They preferably have a substantially uniform diameter frequency distribution, e.g. 95% by weight of the silver halide grains can have a diameter that is within about 40%, preferably within about 30% of the mean grain diameter.

The direct-position silver halide emulsions for use according to the present invention are of the type that comprises electron-traps.

A first type of such emulsions contain interior electron-traps. They comprise silver halide grains having internal centres promoting the deposition of photolytic silver. Such direct-positive silver halide emulsions have improved sensitivity as shown by E. Moisar and S. Wagner in "Berichte der Bunsengesellschaft fur physikalische Chemie" 67 (1963) 356–359. Photographic emulsions comprising in the interior of the silver halide grains centres promoting the deposition of photolytic silver can be prepared, e.g., as described in U.K. Patent Specification 1,027,146 of Agfa A.G. filed Aug. 30, 1963. For this purpose, a homodisperse fine-grain silver halide emulsion with narrow grain-size distribution is made first, preferably by the double jet silver halide precipitating technique. These fine silver halide grains will serve as cores for the ultimate emulsion.

The silver halide cores thus formed are then treated so as to produce centres that promote the deposition of photolytic silver (electron-traps) on the cores. For this purpose, the cores may be treated chemically or physically according to any of the known procedures for producing ripening nuclei i.e., latent image nucleating centres. Such procedures are described, e.g., by A. Hautot and H. Sauvenier in "Sci. et Ind. Phot.", Vol. XXVIII, Jan. 1957, p.1–23 and 57–65.

The ripening nuclei can be formed by chemical sensitization by means of noble metal compounds, especially gold or iridium compounds, by means of sulphur compounds, e.g. thiosulphates, or by means of both noble metal compounds and sulphur compounds. Ripening of the silver halide cores can also be effected by means of reducing agents, e.g. hydrazin, thiourea or tin(II) chloride, if optionally together with noble metal compounds.

Electron-traps can further be provided by treating the silver halide cores with aqueous solutions of salts of polyvalent metals e.g. of the trivalent bismuth.

It is also possible to use the compounds suitable for the formation of the electron-traps, e.g. the chemical sensitizers referred to hereinbefore, during the precipitation of the fine-grain silver halide i.e., during the formation of the cores for the ultimate silver halide emulsion. In this way, the electron-traps are distributed statistically in the interior of the cores contrary to when the compounds are added after the formation of the fine-grain silver halide where the electron-traps are formed substantially at the surface of the cores. After the formation of the cores having centres promoting the deposition of photolytic silver, silver halide precipitation is continued to form around the cores an outer shell of silver halide.

Another type of direct-positive silver halide emulsions comprising electron-traps are emulsions that comprise common silver halide grains and exterior electron-traps by the presence of one or more electron-accepting or desensitizing compounds.

According to Sheppart et al J. Phys. Chem. 50 (1946) 210, Stanienda, Z. Phys. Chem. (NF) 32 (1962) 238, and Dähne, Wiss. Phot. (1969) 161, desensitizers are dyestuffs whose cathodic polarographic half-wave potential, measured against the calomel electrode, is more positive than −1.0 V. Suchlike compounds have also been described in U.S. Patent Specifications 3,501,305–3,501,306 and 3,501,307 all of Bernard D. Illingsworth issued Mar. 17, 1970. The sensitizers described in German Patent Specification 1,153,246 filed Apr. 11, 1962 by Agfa A.G. and U.S. Pat. No. 3,314,796 Johannes Gotze, August Randolph and Oskar Riester issued Apr. 18, 1967 are also suitable for this purpose as well as imidazo-quinoxaline dyestuffs, e.g. those described in Belgian Patent Specification 660,253 filed Feb. 25, 1965 by Kodak Co.

It is known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

Inorganic electron-accepting compounds may also be used in the present invention, e.g. mercury(II) compounds such as mercury(II) oxide, mercury(II) chloride, mercury(II) cyanide, etc.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof, such as esters, amides and salts thereof etc. or synthetic hydrophilic resins; e.g. polyvinyl alcohol and poly-N-vinyl pyrrolidone, acrylamide polymers, cellulose ethers, partially hydrolyzed cellulose acetate and the like.

The direct-positive silver halide emulsions for use in accordance with the present invention may comprise all kinds of known emulsion ingredients for direct-positive emulsions. They may comprise, e.g., speed-increasing compounds e.g. polyalkylene glycols and derivatives thereof, cationic surface active agents of the ammonium, sulphonium and phosphonium type, thioethers, etc. They may further comprise antifoggants and stabilizers, which include thiazolium salts, azaindenes, e.g. hydroxytetraazaindenes such as 5-methyl-7-hydroxy-s-triazolo[1,5-a]pyrimidine, mercury compounds, nitroindazoles, nitrobenzimidazoles, mercaptotetrazoles such as 1-phenyl-5-mercaptotetrazole, etc.

Spectrally sensitizing dyes which are not electron-accepting may also be present in the emulsion, e.g. cyanines, merocyanines, complex (trinuclear) cyanines, complex (trinuclear) merocyanines, styryls and hemicyanines. The direct-positive emulsions may also contain blue-speed increasing compounds as defined in British Patent Specification 1,186,718 filed Mar. 17, 1967 by Kodak Co.

Further, colour couplers may be incorporated in the direct-positive emulsions employed in the present invention. Particularly suitable are colour couplers showing a low halogen-accepting character, which can be determined by the test described by R. P. Held in Phot. Sci. Eng. Vol. 11 (1967) p.406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through halogen acceptance by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct-positive photographic silver halide emulsion according to any suitable technique known to those skilled in the art for incorporating colour couplers in silver halide emulsions. For example, water-soluble colour couplers, e.g. those containing one or more sulpho or carboxyl groups (in acid or salt form), can be incorporated from an aqueous solution, if necessary, in the presence of alkali, and the water-insoluble or insufficiently water-soluble colour couplers from a solution in the appropriate water-miscible or water-immisible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent is removed afterwards by evaporation.

The silver halide emulsion layer and any other hydrophilic colloid layer, which may be present in a direct-positive photographic material employed in accordance with the present invention, may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides, vinylsulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The direct-positive silver halide emulsions can be coated on one or both sides of a wide variety of supports which include opaque supports, e.g. paper and metal supports as well as transparent supports, e.g. glass, cellulose nitrate film, cellulose acetate film, cellulose aceto-butyrate film, polyvinylacetal film, polystyrene film, polyethylene terephthalate film, polycarbonate film and other films of resinous materials. It is also possible to employ paper coated with $\alpha$-olefin polymers, e.g. paper coated with polyethylene, polypropylene, ethylene-butylene copolymers etc.

The following examples illustrate the present invention.

EXAMPLE 1

A monodisperse cubic direct-positive photographic silver bromoiodide (2.5 mole % of iodide) having an average grain size of about 0.1 micron was prepared under controlled pH, pAg, and temperature conditions, during precipitation of the silver halide. The pH was maintained at 5.5, the pAg at 8.2, and the temperature at 45° C. The pAg was then adjusted to 10 whereupon the emulsion was chill-set, shredded and washed with cold water.

The emulsion was divided into several aliquot portions and each portion was digested at 60° C with a gold compound (15 mg of hydrogen tetrachloroaurate(III) per mole of silver halide) at pH 7 and pAg 5.30, for a period of time as listed in the table below.

After addition of 600 mg of pinacryptol yellow per mole of silver halide, the emulsion portions were coated on a conventional support at coverages of 3.75 g of silver and 3.75 g gelatin per sq.m.

The materials were dried and cut into several strips. Without previous exposure each strip was developed at 20° C as follows:

6 min. in Developer A of the following composition:

N-methyl-p-aminophenol sulphate — 2.5 g
sodium sulphite — 30 g
hydroquinone — 2.5 g
sodium metaborate — 10 g
potassium bromide — 0.5 g
water to make — 1 litre 6 min. in Developer B: having the same composition of developer A with the only difference that the potassium bromide was omitted 3 min. in Developer C having the composition of the test developer given hereinbefore at page 4 to which 0.5 g of potassium bromide per liter was added 3 min. in Developer D having the composition of the test developer given hereinbefore at page 4 (comprising no potassium bromide).

The developed strips were fixed, washed, and dried in the usual way. The results attained were as follows.

| emulsion portion | digestion time | Density developer A | developer B | developer C | developer D |
|---|---|---|---|---|---|
| I | 1 hour | 0.16 | 0.26 | 0.60 | 1.37 |
| II | 2 hours | 0.42 | 0.61 | 1.12 | 2.30 |
| III | 3 hours | 1.10 | 1.45 | 1.67 | 3.22 |
| IV | 4 hours | 2.06 | 2.42 | 2.80 | 4.20 |

The above results show that the density can be increased by carrying out development in the absence of potassium bromide; this increase is very pronounced in the high energy test developer comprising the superadditive developing combination of hydroquinone and 1-phenyl-3-pyrazolidinone.

The results further show that it is possible to reduce the degree of fogging considerably and nevertheless obtain sufficient density by high energy development in the absence of potassium bromide.

EXAMPLE 2

A direct-positive silver halide emulsion was prepared as described in example 1 and doped with a gold compound as described for emulsion portion I of example 1.

The emulsion was divided into several aliquot portions, which were coated on a conventional support as described in example 1.

Without previous exposure the various emulsion samples were developed for 3 min. at 20° C in the test developer whose composition has been given hereinbefore. For each sample, an increasing amount of potassium bromide was added to the developer.

After development, the emulsions were fixed, washed, and dried in the usual way.

The results were as follows:

| g potassium bromide per liter | density |
|---|---|
| — | 1.38 |
| 0.5 | 0.60 |
| 1 | 0.42 |
| 2 | 0.23 |
| 3 | 0.14 |
| 4 | 0.12 |
| 5 | 0.11 |

The above results show the decrease of density with increasing content of potassium bromide in the developer.

EXAMPLE 3

Emulsion samples that were prepared as described in example 2 and thus wherein the silver halide grains had been fogged to a level below that described in Illingsworth's U.S. Pat. No. 3,501,307 were developed in the absence of potassium bromide in developing compositions whose energy was increased by the use of increasing concentrations of the developing agents.

Except for the concentration of the developing agents used, which are listed in the table below, the developing compositions were as described hereinbefore for the test developer. Development occurred at 20° C for 3 min.

The results given below show that even with this low degree of fogging, which enhances the speed of the emulsion, high densities can be obtained by means of developers comprising no potassium bromide.

| hydroquinone g/liter | 1-phenyl-3-pyrazolidinone g/liter | density |
|---|---|---|
| 5 | 1 | 0.98 |
| 10 | 1 | 1.28 |
| 15 | 1 | 1.38 |
| 20 | 1 | 1.44 |
| 15 | 2 | 1.65 |
| 15 | 3 | 2.07 |
| 15 | 5 | 2.47 |
| 15 | 10 | 3.17 |

EXAMPLE 4

To an emulsion prepared as described in example 1 (portion II), a colour coupler was added having the following formula:

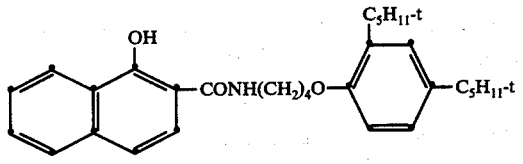

The colour coupler was added in an amount such that after coating on a support 1.2 g of colour coupler was present per sq.m.

After coating of the emulsion on a support in a proportion of 3 g of silver per sq.m., the material was cut into several aliquot strips.

Without previous exposure one of the strips was developed for 5 min. at 20° C in a developing bath of the following composition:

| | |
|---|---|
| sodium hexametaphosphate | 2 g |
| anhydrous sodium sulphite | 4 g |
| anhydrous potassium carbonate | 35 g |
| 40 % aqueous potassium hydroxide | 8 ml |
| hydroxylamine hydrochloride | 3 g |
| N-ethyl-N-hydroxyethyl-p-phenylenediamine hydrochloride | 8 g |
| water to make | 1 liter (pH :10.7) |

The other strips were developed for 5 min. at 20° C in a developing bath of the above composition, to which increasing amounts of potassium bromide were added as a listed in the table below.

After development, the samples were washed, fixed, and bleached in the usual way.

The colour densities obtained are listed below

| potassium bromide g/liter | colour density |
|---|---|
| — | 2.55 |
| 0.5 | 0.82 |
| 1 | 0.52 |
| 2 | 0.33 |
| 5 | 0.25 |

The above results show that the colour density decreases with increasing concentration of potassium hydroxide in the developer.

EXAMPLE 5

An emulsion was prepared as described in example 1, with the difference that it was digested for 2 hours at 60° C and at pAg 8.20 instead of pAg 5.30. After coating on a support as described in example 1, the material was cut into six strips. One strip was developed for 3 min. at 20° C in the test-developer, whose composition has been given above. Two other strips were developed for 3 min. at 20° C in viscous developers A and B obtained by mixing the composition of the test developer with carboxymethylcellulose to reach a viscosity at 20° C to 70 cP and 750 cP respectively.

The three remaining emulsion strips were developed in the same developers with the difference that 0.5 g of potassium bromide was added thereto.

The results were as follows.

| Developer | Density | |
|---|---|---|
| | without KBr | plus KBr |
| test | 1.80 | 1.06 |
| A | 2.04 | 1.02 |
| B | 2.10 | 1.20 |

The results once again show the favourable effect of leaving out the potassium bromide.

EXAMPLE 6

A monodisperse cubic direct-positive photographic silver bromoiodide emulsion as described in example 1 was divided into two aliquot portions.

To emulsion portion A were added 0.10 mg of thiourea dioxide and 15 mg of hydrogen tetrachloroaurate (III) per mole of silver halide at pH 7, pAg 8.5, and 60° C. Heating at 60° C occurred for 60 min. After addition, per mole of silver halide, of 600 mg of pinacryptol yellow as electron-acceptor and 600 mg of the spectrally sensitizing dye with formula:

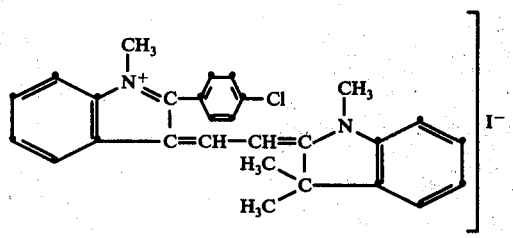

the emulsion portion was coated on a conventional film support at coverages of 3.75 g of silver and 3.75 g of gelatin per sq.m. The emulsion portion was then dried, exposed in a sensitometer, and developed at 20° C for 3 min. in the test developer, whose composition has been given above.

The maximum density obtained was 1.14,whereas with an identical test portion, when developed for 5 min. in developer A of example 1, a maximum density of 0.19 was attained, which is unsuitable for practical use.

Emulsion portion B was treated and coated in the same way as emulsion portion A with the only difference that now 30 mg of thiourea dioxide were used in order to reach approximately the same maximum density as obtained for emulsion portion A. The emulsion portion was developed for 3 min. at 20° C in the test developer to which 0.5 g of potassium bromide was added. The maximum density attained was 1.02.

The photographic speeds of both emulsion portions, measured at the mean density between minimum and maximum density, are listed in the table below. The values given for the speed are relative values, that of the emulsion portion A being 100.

| emulsion | speed | $D_{max}$ |
|---|---|---|
| A | 100 | 1.14 |
| B | 31 | 1.02 |

The above results show that upon development in the absence of potassium bromide (emulsion portion A) the same maximum densities can be obtained as upon development in the presence of potassium bromide (emulsion portion B) with lower degrees of fogging, which results in increased speed values.

EXAMPLE 7

A monodisperse silver bromide emulsion having an average grain size of about 0.2 micron was prepared under controlled pAg, pH, and temperature conditions during precipitation of the silver halide. The pH was maintained at 3, the pAg at 8.5, and the temperature at 50° C. The pAg of the emulsion was then adjusted to 10 whereupon the emulsion was chill-set, shredded and washed with cold water.

The emulsion was doped with 7.14 mg of hydrogen tetrachloroaurate(III) per mole of silver halide, the pH adjusted to 7 and the pAg to 8.18, whereupon the emulsion was digested for 3 hours 45 minutes at 55° C.

After the addition per kg of 72 mg of pinacryptol yellow as electron acceptor and 72 mg of the spectral sensitizer having the formula given in example 6, the emulsion was coated on a conventional film support so that an amount of silver halide equivalent to 5 g of silver nitrate was present per sq.m.

After drying the film material was cut into two strips. Without previous exposure one strip was developed for 3 min. at 20° C, in a developer being a mere aqueous alkaline (pH:11) solution of 5 g of 1-phenyl-3-pyrazolidinone and 20 g of ascorbic acid per litre, whereas the other strip was developed for 3 min. at 20° C in the same solution to which 0.5 g of potassium bromide was added per litre.

The densities obtained were 2.10 and 1.65 respectively, which proves that in the absence of potassium bromide higher densities are developable.

We claim:

1. A method of producing a direct-positive image comprising (1) providing a photographic element comprising at least one direct-positive silver halide emulsion layer with fogged silver halide grains containing electron traps selected from the group consisting of -

(a) silver halide grains having adsorbed to the surface thereof one or more electron-accepting compounds having an anodic polarographic half-wave potential and a cathodic polarographic half-wave potential which when added together give a positive sum, and (b) silver halide grains, having in their interior, centers which promote the deposition of photolytic silver, said fogging of the silver halide grains producing a density of less than 0.5 when developed without exposure for 6 minutes at 20° C. in Kodak DK-50 developer when such an emulsion is coated on a support at a coverage of 0.50 g to 5.50 g silver per sq.m. and to such an extent that a test portion of the silver halide emulsion, when coated on a support at a coverage of 0.50 to 5.50 g of silver per square meter gives a density of at least 0.50 upon processing without previous exposure for 3 minutes at 20° C. in a test developer of the following composition:

| | |
|---|---|
| hydroquinone | 15 g |
| 1-phenyl-3-pyrazolidinone | 1 g |
| trisodium salt of ethylenediamine tetraacetic acid | 1 g |
| anhydrous sodium carbonate | 30 g |
| anhydrous sodium sulphite | 70 g |
| 40% aqueous sodium hydroxide | 16 ml |
| water to make | 1 liter (pH:11) ; |

(2) imagewise exposing said photographic element to radiation; and (3) developing said exposed photographic element with an alkaline high energy developer selected from the group consisting of hydroquinone/1-phenyl-3-pyrazolidinone developing composition; an ascorbic acid/1-phenyl-3-pyrazolidinone developing composition; hydroquinone/N-methyl-p-aminophenol sulphate developing composition, and a p-phenylene diamine developing composition, said developer being substantially free from halide ions during development.

2. Method according to claim 1 wherein the silver halide grains have been fogged by reduction sensitization.

3. Method according to claim 2, wherein the silver halide grains have been fogged by means of thiourea dioxide or tin(II) chloride.

4. Method according to claim 1, wherein the silver halide grains have been fogged by sensitization with a compound of a metal more electropositive than silver.

5. Method according to claim 4 wherein the compound is a gold compound.

6. Method according to claim 1, wherein the silver halide grains have been fogged by reduction sensitization and sensitization with a compound of a metal more electropositive than silver.

7. Method according to claim 6, wherein said compound is a gold compound.

8. Method according to claim 1 wherein said developer includes a thickening agent.

9. Method according to claim 8 wherein said thickening agent is a water-soluble film-forming material.

10. Method according to claim 1 wherein the developer is hydroquinone/N-methyl-p-aminophenol sulphate.

11. Method according to claim 1 wherein the developer is hydroquinone/1-phenyl-3-pyrazolidinone.

12. Method according to claim 1 wherein the developer is ascorbic acid/1-phenyl-3-pyrazolidinone.

13. Method according to claim 1 wherein the developer contains hydroquinone in an amount of at least 5 g per litre.

14. Method according to claim 1 wherein said developing agent is a p-phenylenediamine developing agent.

* * * * *